US006772577B2

(12) United States Patent
Panneri

(10) Patent No.: US 6,772,577 B2
(45) **Date of Patent: *Aug. 10, 2004**

(54) BRANDING FIXTURE STRUCTURES

(75) Inventor: Alfred J. Panneri, Cheektowaga, NY (US)

(73) Assignee: A. J. Panneri Enterprises, Inc., Cheektowaga, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/299,238

(22) Filed: Nov. 19, 2002

(65) Prior Publication Data

US 2003/0070402 A1 Apr. 17, 2003

Related U.S. Application Data

(63) Continuation-in-part of application No. 09/732,661, filed on Dec. 8, 2000, now Pat. No. 6,508,048.

(51) Int. Cl.[7] ..... B65B 11/00

(52) U.S. Cl. ..... 53/586; 53/589; 53/590; 100/10; 100/25

(58) Field of Search ..... 53/586, 589, 590; 100/10, 25, 26

(56) References Cited

U.S. PATENT DOCUMENTS

| | | | | |
|---|---|---|---|---|
| 3,021,653 A | | 2/1962 | Marshall | |
| 4,162,600 A | | 7/1979 | Westall et al. | |
| 4,570,422 A | | 2/1986 | Watanabe et al. | |
| 4,783,948 A | | 11/1988 | Kando | |
| 4,832,767 A | | 5/1989 | Eller | |
| 4,852,329 A | | 8/1989 | Terragnoli | |
| 4,875,325 A | | 10/1989 | Gamberini et al. | |
| 4,930,293 A | | 6/1990 | Hanscom | |
| 5,063,803 A | | 11/1991 | Panneri et al. | |
| 6,508,048 B2 | * | 1/2003 | Panneri | 53/586 |
| 6,557,326 B1 | * | 5/2003 | Panneri | 53/586 |

OTHER PUBLICATIONS

Previous banding fixture, no date.

* cited by examiner

*Primary Examiner*—Stephen F. Gerrity
*Assistant Examiner*—Hemant M Desai
(74) *Attorney, Agent, or Firm*—Joseph P. Gastel

(57) ABSTRACT

A banding fixture including a body having a horizontal opening therein, a carriage movable into and out of the horizontal opening, a recess in the carriage, the carriage with the recess therein movable into the horizontal opening with an upper surface on the carriage in underlying near contiguous relationship to an undersurface of a plate on the body, and a workpiece-receiving slot in the body above the horizontal opening. A method of banding a workpiece including the steps of placing a band into spaced slots having sides, pressing a workpiece overlying a central portion of the band which is not in the slots into a recess in a member, and moving the member relative to a surface so that the ends of the band which extend beyond the workpiece are pressed together in overlapping relationship as the member passes in contiguous relationship to the surface.

35 Claims, 9 Drawing Sheets

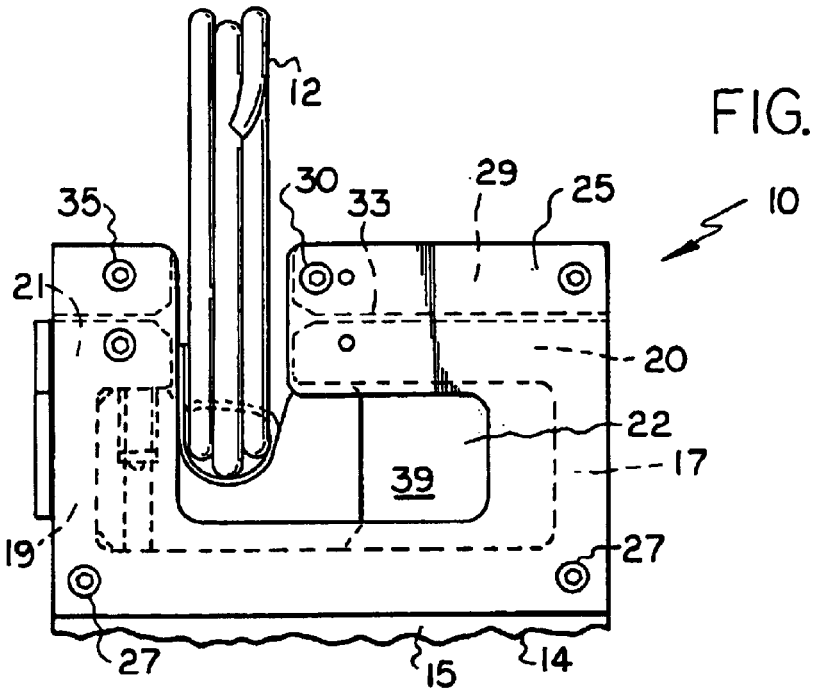
FIG. 9
FIG. 2A
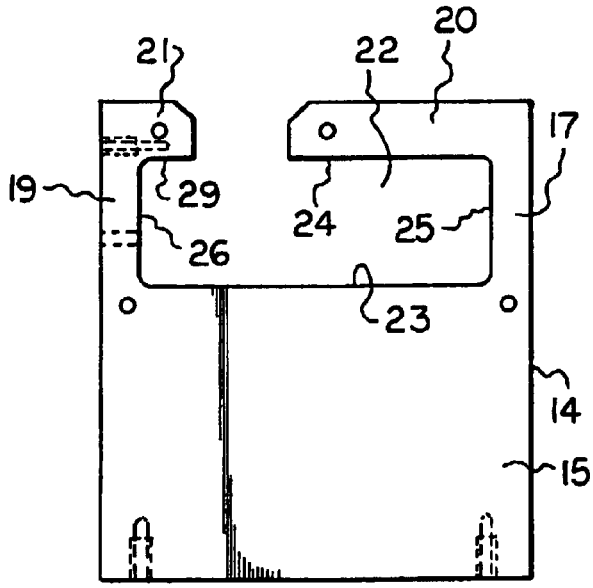
FIG. 2C
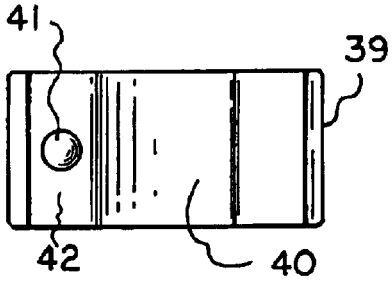
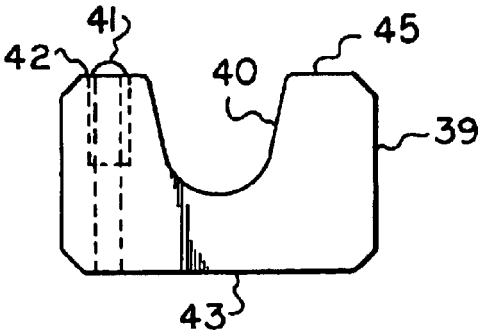
FIG. 2B

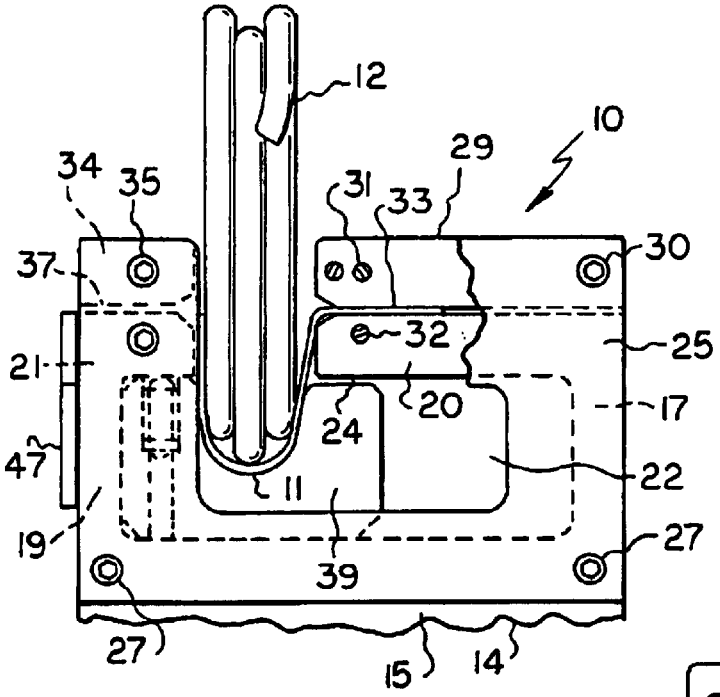
FIG. 6
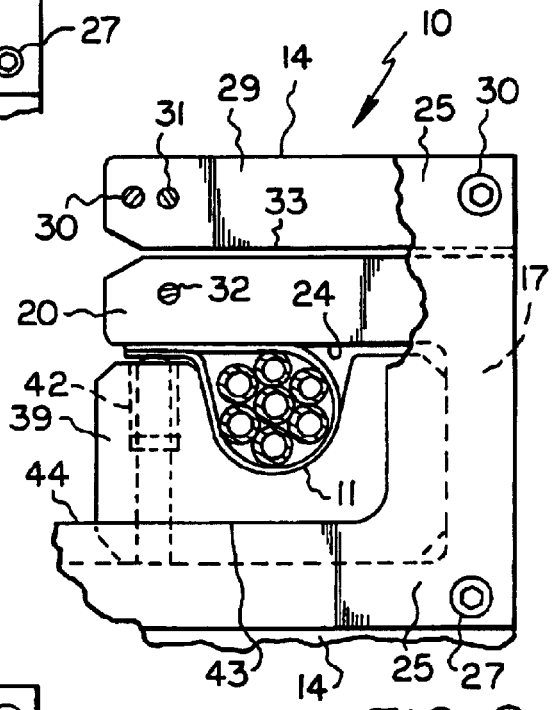
FIG. 8
FIG. 7
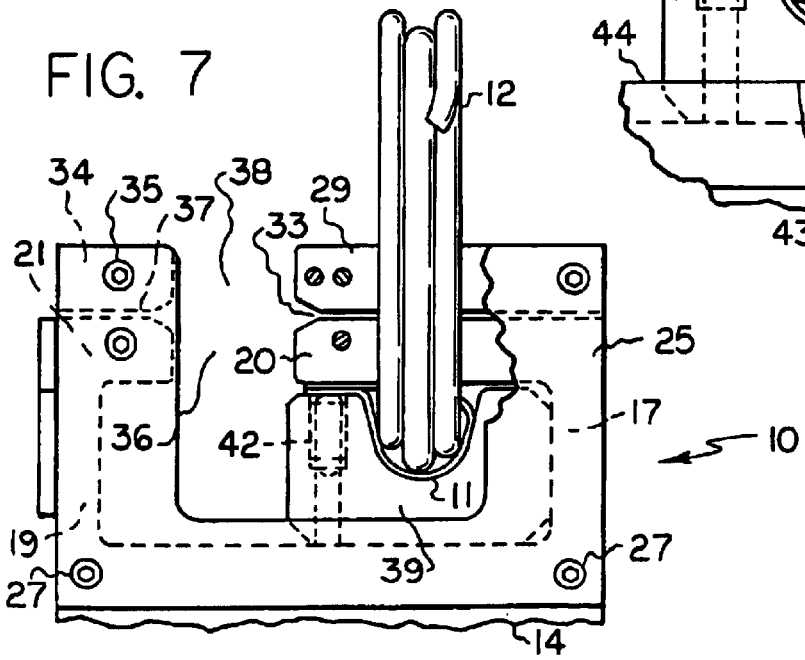

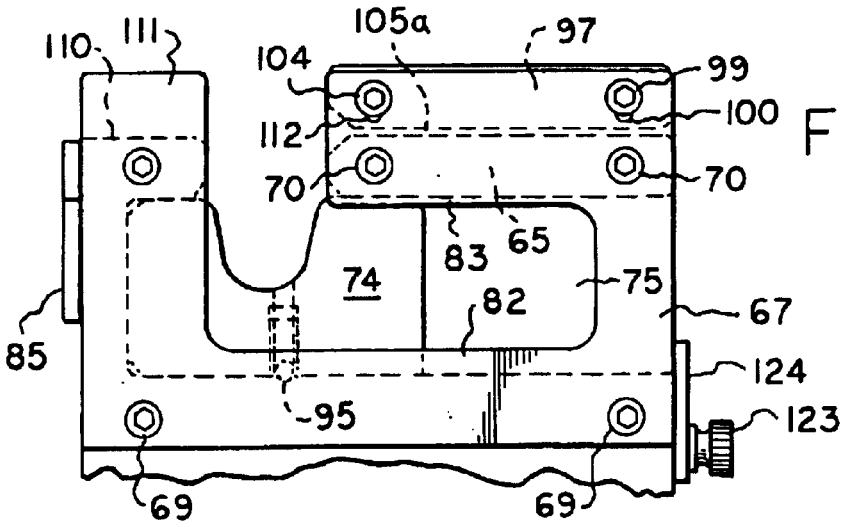
FIG. 18
FIG. 19
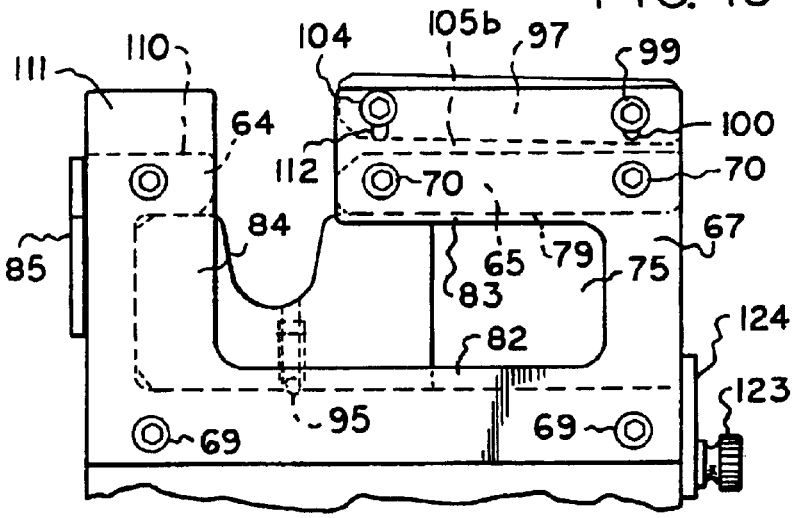
FIG. 20
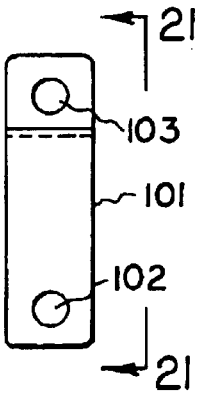
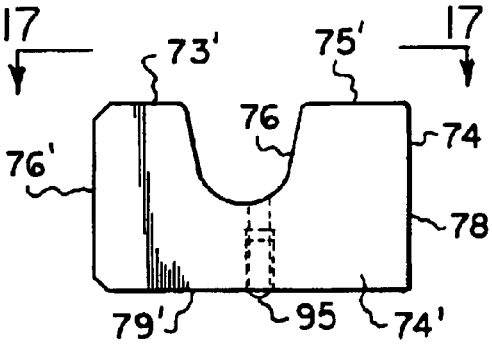
FIG. 15
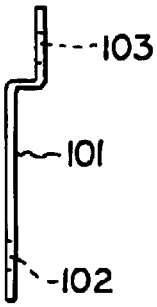
FIG. 21
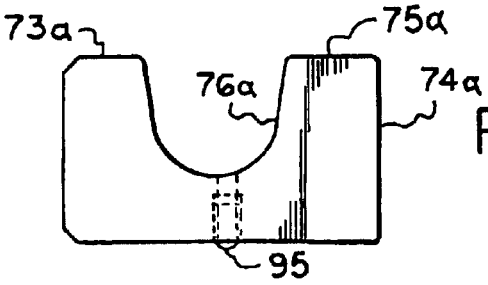
FIG. 16

FIG. 22
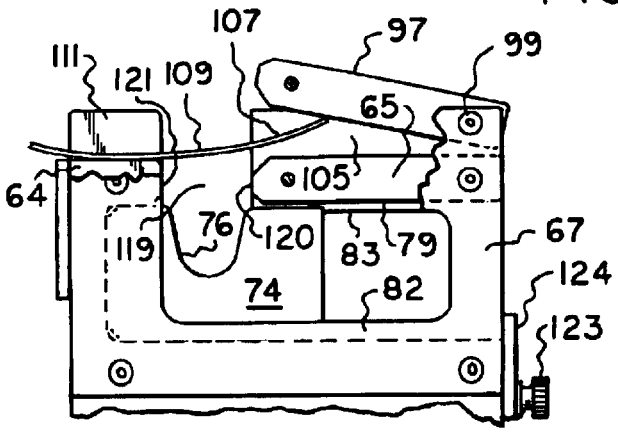
FIG. 23
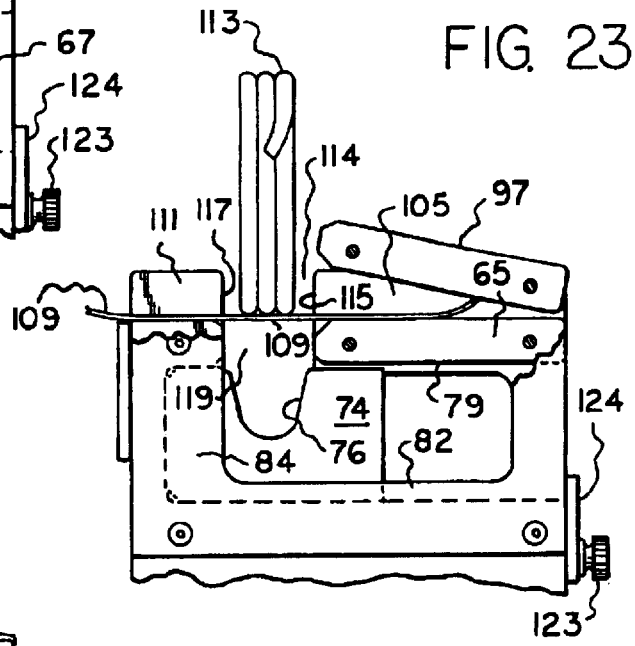
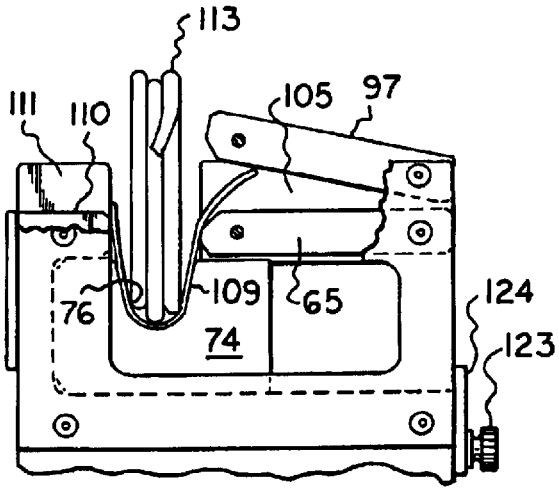
FIG. 24
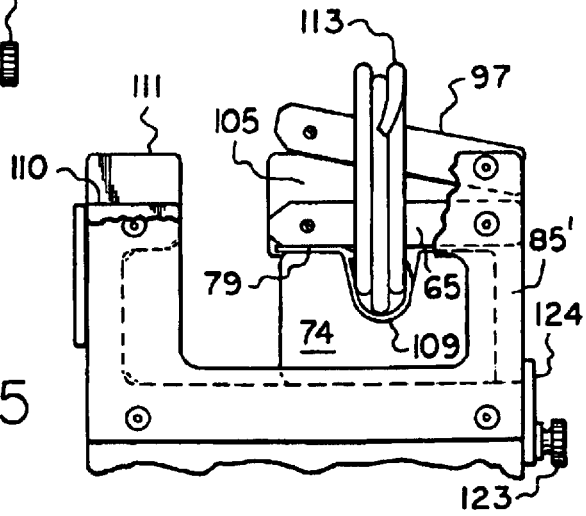
FIG. 25

BRANDING FIXTURE STRUCTURES

CROSS-REFERENCE TO RELATED APPLICATIONS

The present application is a continuation-in-part of application Ser. No. 09/732,661, filed Dec. 8, 2000 now U.S. Pat. No. 6,508,048.

STATEMENT REGARDING FEDERALLY SPONSORED RESEARCH OR DEVELOPMENT

Not Applicable

BACKGROUND OF THE INVENTION

The present invention relates to an improved banding fixture for applying a band to a coil or bundle of material.

By way of background, a workpiece, such as coiled material or a bundle of material, require bands to retain them in assembled condition. It is also desirable that the ends of the band which cohere to each other be in as close overlapping alignment as possible so that any of the surfaces which should adhere to each other are not exposed.

BRIEF SUMMARY OF THE INVENTION

It is the object of the present invention to provide a banding fixture for material which has to be banded which accepts a predetermined length of band and guides this band during a manually manipulatable operation about a coil or bundle and causes the ends of the band to be secured to each other in substantially exact overlying relationship.

It is another object of the present invention to provide a banding fixture which permits a simple interchange of coil-receiving carriages for receiving different sizes of coils or bundles.

A further object of the present invention is to provide a banding fixture which includes an adjustable band-receiving slot.

Yet another object of the present invention is to provide a banding fixture which includes a simplified band-receiving structural arrangement. Other objects and attendant advantages of the present invention will readily be perceived hereafter.

The present invention relates to a banding fixture comprising a body, a horizontal opening in said body, an overlying portion on said body overlying said horizontal opening, an undersurface on said overlying portion, a carriage movable into and out of said horizontal opening, a recess in said carriage, a carriage portion to the side of said recess, an upper surface on said carriage portion positionable in underlying near contiguous relationship with said undersurface, and a band-receiving slot in said body above said horizontal opening.

The present invention also relates to a banding fixture comprising a body, a horizontal opening in said body, a carriage movable in said horizontal opening, a recess in said carriage, and a window in said body in substantial alignment with said horizontal opening.

The present invention also relates to a banding fixture comprising a body, a horizontal opening in said body, a carriage movable in said horizontal opening, a recess in said carriage, and a band-receiving slot above said horizontal opening.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 2A is a side elevational view of the body of the fixture;

FIG. 2B is a side elevational view of the carriage;

FIG. 2C is a plan view of the carriage;

FIG. 6 is a view similar to FIG. 5 but showing the coil moved into the carriage on the fixture;

FIG. 7 is a view similar to FIG. 6 but showing the carriage moved to a position wherein the band has been installed about the coil;

FIG. 8 is an enlarged fragmentary view similar to FIG. 7 but showing the coil in cross section with the band installed thereon;

FIG. 9 is a view similar to FIG. 7 but showing the carriage moved to a position which permits the banded coil to be removed from the fixture;

FIG. 15 is a side elevational view of one form of carriage;

FIG. 16 is a side elevational view of another form of carriage;

FIG. 18 is a fragmentary side elevational view of the upper portion of the fixture with the band-receiving slot in a very narrow orientation;

FIG. 19 is a fragmentary side elevational view of the upper portion of the fixture with the band-receiving slot slightly opened from its position in FIG. 18;

FIG. 20 is a front elevational view of a bracket which is used to place the slot in the open position of FIG. 10;

FIG. 21 is a side elevational view of the bracket taken substantially in the direction of arrows 21—21 of FIG. 20;

FIG. 22 is a fragmentary side elevational view showing the fixture with the band-receiving slot in a position for receiving a band which tends to curl upwardly;

FIG. 23 is a fragmentary side elevational view similar to FIG. 22 with the band in its final position and a coil being placed in position to receive the band;

FIG. 24 is a fragmentary side elevational view similar to FIG. 23 and showing the coil in position in the recess of the carriage with the band therebetween;

FIG. 25 is a fragmentary side elevational view similar to FIG. 24 but showing the carriage in the position wherein the band has its ends secured to each other.

DETAILED DESCRIPTION OF THE INVENTION

Figure 1:
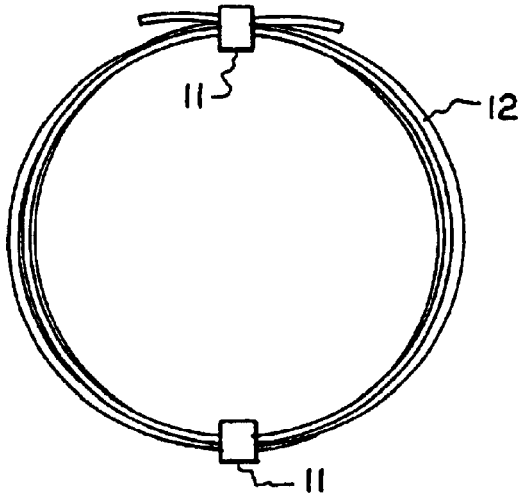
FIG. 1 is a side elevational view of a coil of tubing which is banded by bands which have been applied by the present banding fixture.

Summarizing briefly in advance, the banding fixture 10 is for applying bands 11 to a workpiece such as a coil 12 of tubing or any other type of coiled material or material to be banded. The bands 11 are received in a predetermined length from a band-dispensing machine of any type which can supply it. Each band, by the use of fixture 10, can then be banded about the coiled material.

The banding fixture 10 includes a body 14 fabricated out of a suitable plastic material. Body 14 includes a lower plastic portion 15 (FIG. 2A) of substantially rectangular configuration. Formed integrally with lower portion 15 are two narrow members 17 and 19. Member 17 merges into a horizontal member 20 and member 19 merges into a horizontal member 21. A horizontal opening 22 (FIGS. 2 and 2A) is defined by edge 23 (FIG. 2A) of lower body member 15, edge 24 of member 20, edge 25 of member 17, edge 26 of member 19 and edge 29' of member 21.

Metal plates 25 are screwed to body 14 by screws 27. A substantially rectangular block 29 (FIG. 2) is secured between plates 25 by screws 30 and by a plastic pin 31. A plastic pin 32 also extends through plates 25 and body portion 20. A band-receiving slot 33 is thus formed between block 29 and body portion 20. A second block 34 is secured between plates 25 by screws 35. A slot 37 is located between body portion 21 and block 34.

Figure 2:
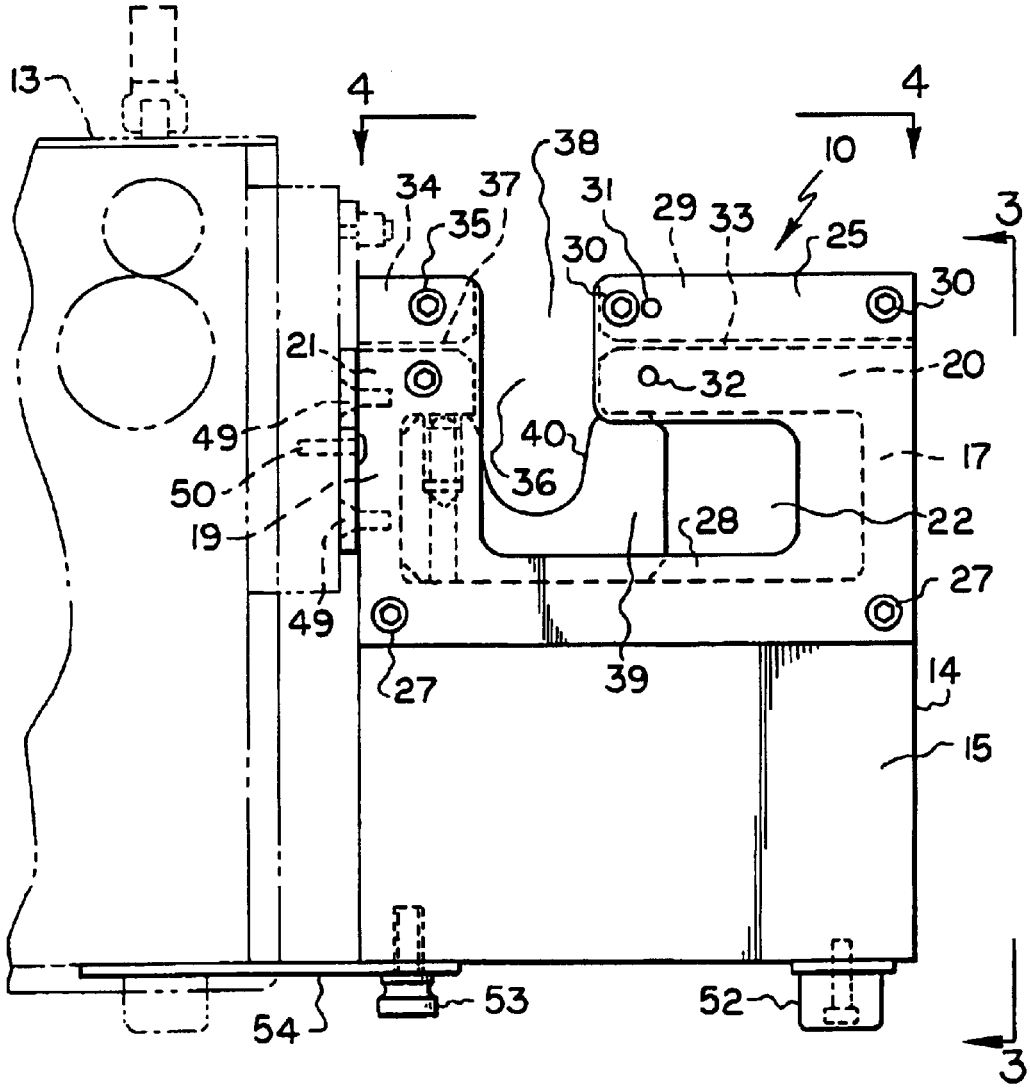
FIG. 2 is a side elevational view of the banding fixture attached to a machine which supplies bands of a desired length.
Figure 3:
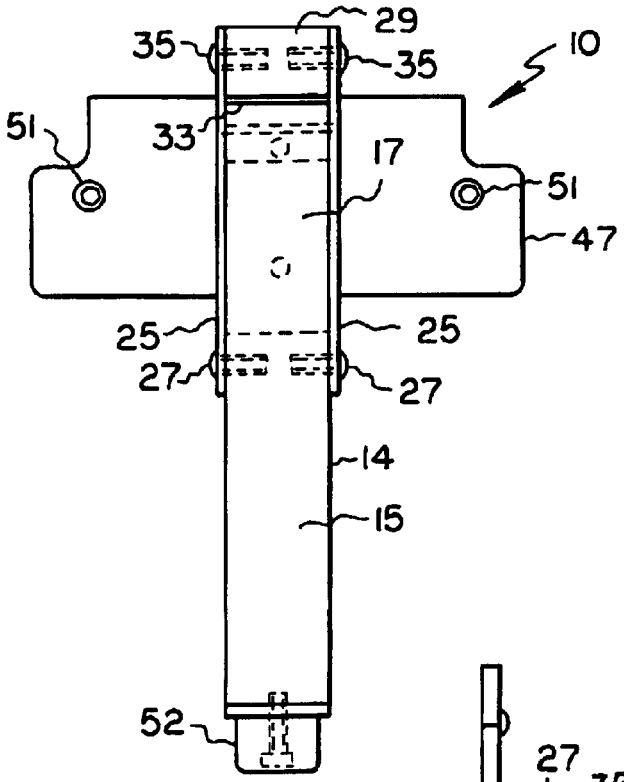
FIG. 3 is an end elevational view taken substantially in the direction of arrows 3—3 of FIG. 2.
Figure 4:
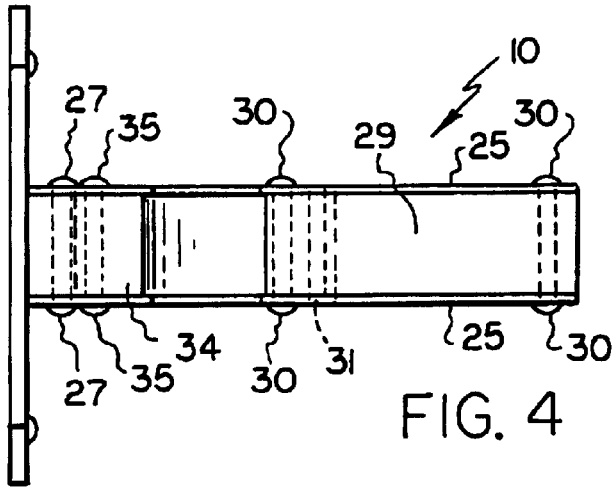
FIG. 4 is a plan view of the fixture taken substantially in the direction of arrows 4—4 of FIG. 2.

A carriage 39 is positioned in horizontal opening 22 for sliding movement between its position shown in FIG. 2 and the position shown in FIGS. 7 and 8. Carriage 39 (FIGS. 2B and 2C) is a plastic block of substantially solid rectangular configuration having a recess 40 therein. Also, a spring-biased ball 41 protrudes from the upper surface 42 of carriage 39. The bottom surface 43 (FIGS. 2B and 8) of carriage 39 slides on surface 23 of body 14, and the top surfaces 45 and 42 (FIG. 2B) travel in close relationship to surfaces 24 and 29 (FIG. 2A) of body 14. As can be seen from FIGS. 2 and 5, the edges 28 of plates 25 which are adjacent to and surround horizontal opening 22 confine carriage 39 for rectilinear movement within horizontal opening 22. A plate 47 (FIG. 3) is secured to body 14 by screws 49 and plate 47 is for securing the fixture 14 to the band-dispensing machine 13 by screws 50 which pass through apertures 51 in plate 47. A leg 52 extends downwardly from body 14 for supporting body 14 on a suitable surface. Also, a screw 53 is threaded into body 14 to support a plate 54 which is attached to the band-dispensing machine 13.

Figure 5:
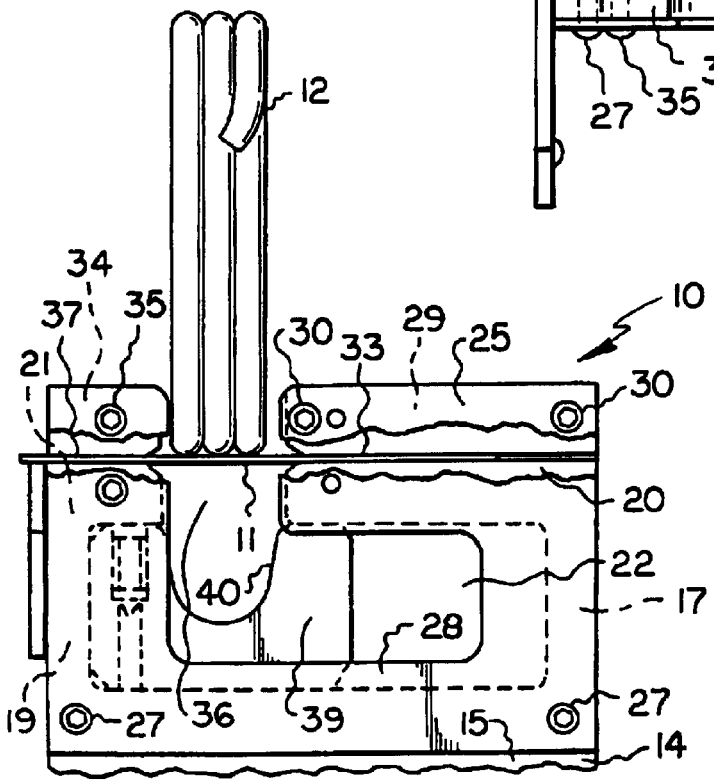
FIG. 5 is a fragmentary side elevational view showing a band in position on the fixture and a coil of tubing at an initial position for subsequent banding.

In operation, a band 11 having a cohesive coating on its upper surface is dispensed from band-dispensing machine into band-receiving slots 37 and 33 and confined against lateral movement by plates 25 on opposite sides of slots 37 and 33. The band 11 is dispensed to a position as shown in FIG. 5 wherein its central portion lies across workpiece-receiving slot 36 in body 14 above the recess 40 in carriage 39. The band 11 is positioned so that after it has been banded about coil 12, its ends will be in perfect overlying relationship as shown in FIG. 8. The workpiece coil 12 is thereafter manually initially positioned in slot 38 between body members 29 and 34 over the central portion of band 11, as shown in FIG. 5, and moved downwardly with the adjacent central band portion of band 11 through slot 36 and into recess 40 of carriage 39, as shown in FIG. 6. Slots 36 and 38, which extend transversely to band-receiving slots 37 and 33, can be considered separately and jointly as a coil-receiving slot, and more broadly as workpiece-receiving slots. When the coil is in the recess 40, portions of the central portion of band 11 will lie along the sides of the coil which are adjacent the lower side of the coil in the lowermost part of recess 40 (FIG. 6). Thereafter, the carriage 39 is manually moved to the position shown in FIG. 7 wherein the ends of band 11 are pressed together between spring-biased ball 41 and the undersurface 24 of member 20 so that the band 11 assumes the condition shown in FIG. 8. During the movement of the carriage 39 into horizontal opening 22 to the position of FIG. 7, a portion of the central portion of band 11 to the right of the coil 12 in FIG. 6 will be moved across the inner side of the coil, and the end portions of the band will be placed in overlapping pressed relationship. Thereafter, the carriage 39 is moved to the position of FIG. 9 whereupon the coil 12 can be withdrawn.

Because the band 11 which is used is of the cohesive type, the surfaces of the band which are pressed together will cohere to each other but the band itself will not adhere to anything else. Because the band 11 is confined against lateral movement in slots 37 and 33 by plates 25 during the banding process, the end portions of the band which cohere to each other will be in exact overlying relationship with all of their edges being perfectly aligned with each other. However, while the side edges of the band are in exact alignment because of the above-noted confinement against lateral movement in slots 37 and 33, under certain circumstances the extreme outer edges on the ends may not be in alignment, depending on the initial placement of the band.

Slots 36 and 38 were designated above as workpiece-receiving slots. In this respect, while the workpiece which was illustrated is a coil 12, it will be appreciated that the "workpiece-receiving slot" can receive a bundle of material which is not in coil form and a single object to which a band has to be applied.

In FIGS. 10–26 another banding fixture embodiment 60 is disclosed. Summarizing briefly in advance, the fixture 60 includes a plurality of features which do not exist in the embodiment 10 of FIGS. 1–9. These features include structure for easily replacing carriages to accommodate different coil sizes. Also, this embodiment includes an adjustable band-receiving slot to accommodate bands having different curl characteristics. In addition, the embodiment of FIGS. 10–26 is more simplified than the embodiment of FIGS. 1–9.

The banding fixture 60 includes a body portion 61 (FIGS. 10 and 13) which is fabricated out of a suitable plastic material. Body portion 61 includes a lower body portion 62 (FIG. 13) of substantially rectangular configuration. Formed integrally with lower body portion 62 is a narrow solid rectangular member 63 which merges into solid rectangular horizontal member 64. The body also includes an upper body portion 65 (FIG. 10) in the form of a substantially solid rectangular plastic block. Two metal plates 67 (FIGS. 10, 11, 12 and 14) secure body portions 61 and 65 to each other. In this respect screws 69 extend through the apertures 68 in the lower portions of plates 67 and are received in bores 76 (FIG. 13) in body portion 61 to fasten these parts together. Screws 70 extend through bores 71 in plates 67 and are received in block 65 to fasten block 65 in position. Screws 72 extend through bores 73 (FIG. 13) in plates 67 to fasten the upper portions of plates 67 to portion 64 of body portion 61.

A plate 85 (FIGS. 10, 11 and 12) is secured to body 61 by screws 87, and screws 89 extend through apertures 90 in plate 85 to secure fixture 60 to band-dispensing machine 13 which will dispense measured lengths of cohesive tape to fixture 60. A foot 91 is secured to the undersurface of lower body portion 62 to rest on a suitable surface. A bracket 92 is fastened to band-dispensing machine 13 by screw 93 and to body portion 61 by screw 94.

A carriage 74 (FIGS. 10, 12, 15) is movable in horizontal opening 75. Carriage 74 is fabricated from a block of plastic, and it has a recess 76 therein. Carriage 74 also includes sides 74' and ends 78 and 76' and a bottom surface 79' and top surfaces 73' and 75' on opposite sides of recess 76. The horizontal opening 75 is defined by edge 77 of lower body portion 62, edge 79 of upper body portion 65, edge 80 (FIG. 13) of lower body portion 61 and edge 81 of body portion 61. The edge portions 82 of plates 67 extend above edge 77 of lower body portion 62, and the edges 83 of plates 67 extend below the lower edge 79 of upper body portion 65 to thereby provide side portions of plates 67 which confine carriage 74 in horizontal opening 75. Also, portions 84 of plates 67 confine the left end of carriage 74 therebetween when the carriage is in the position of FIGS. 10 and 22, and the portions 85' of plates 67 confine the right end of carriage 64 therebetween when the carriage is in the position of FIG. 25. Carriage 74 also includes a spring-biased ball 95 which biases the carriage upwardly so that its upper surfaces 73' and 75' (FIG. 15) will bear against undersurface 79 of body portion 65 and the undersurface 64' of body portion 64 when the carriage is in the position of FIG. 10 and against the undersurface 79 when the carriage 74 is in the position of FIG. 25.

Figure 10:
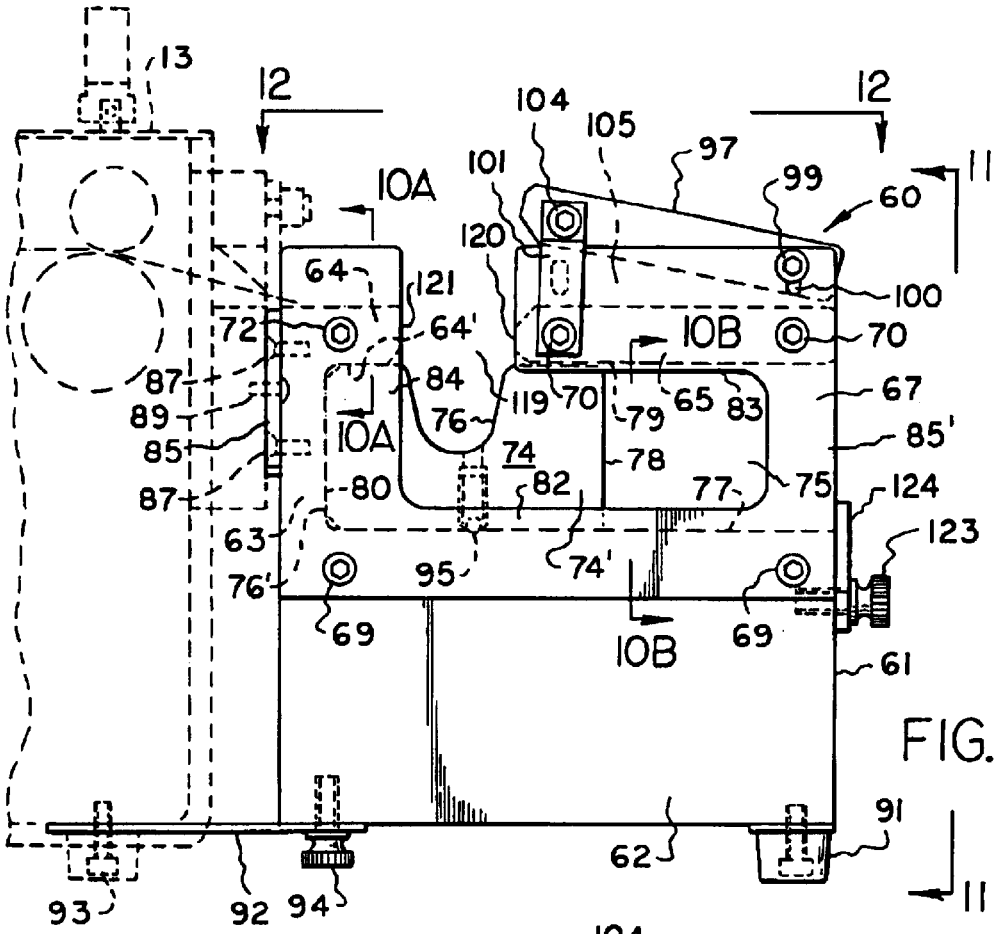
FIG. 10 is a side elevational view of another embodiment of a banding fixture which is attached to a machine which supplies bands of a desired length.
Figure 10B:
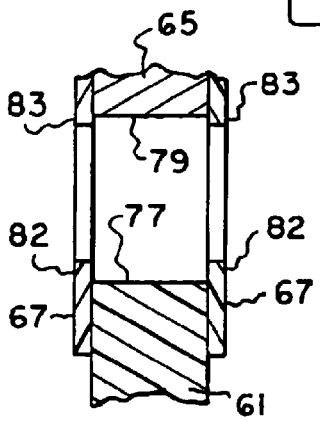
FIG. 10B is a fragmentary cross sectional view taken substantially along line 10B—10B of FIG. 10.
Figure 11:
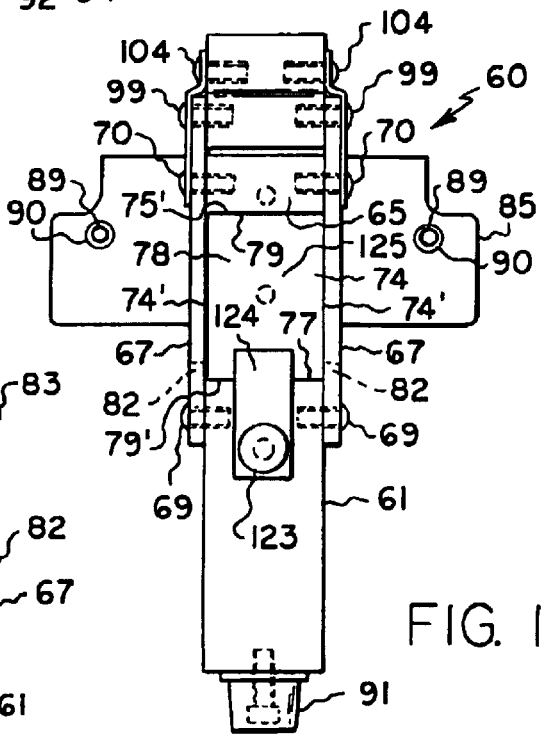
FIG. 11 is an end elevational view taken substantially in the direction of arrows 11—11 of FIG. 10.
Figure 10A:
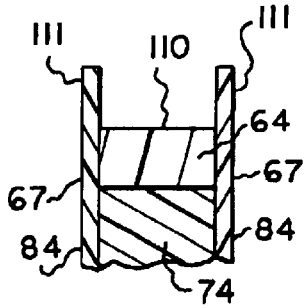
FIG. 10A is a fragmentary cross sectional view taken substantially along line 10A—10A of FIG. 10.
Figure 12:
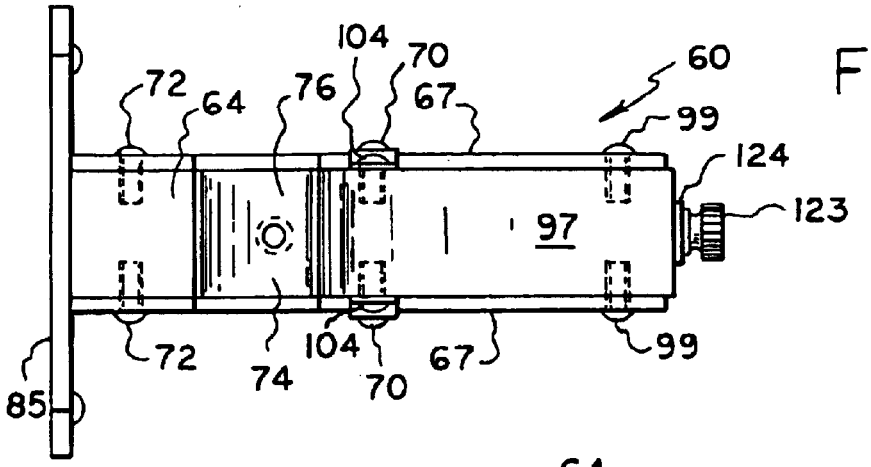
FIG. 12 is a plan view of the fixture taken substantially in the direction of arrows 12—12 of FIG. 10.
Figure 13:
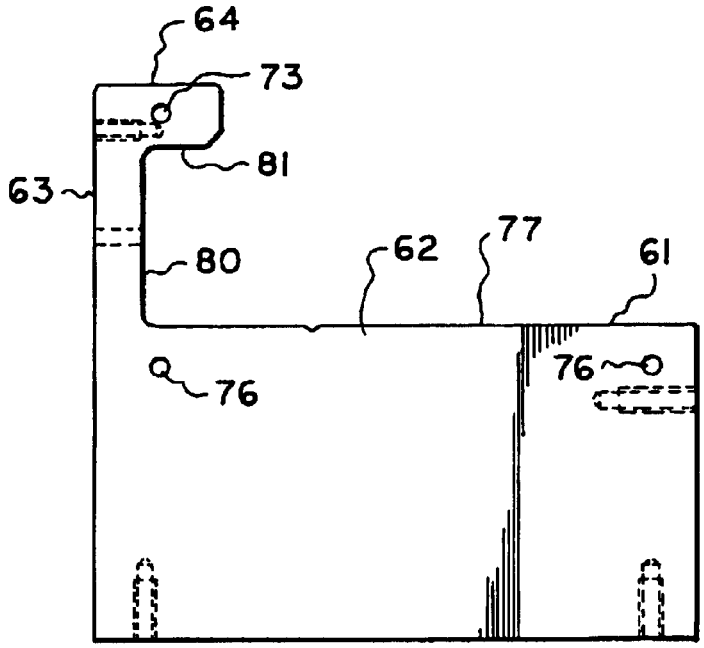
FIG. 13 is a side elevational view of the lower body member of the fixture.
Figure 14:
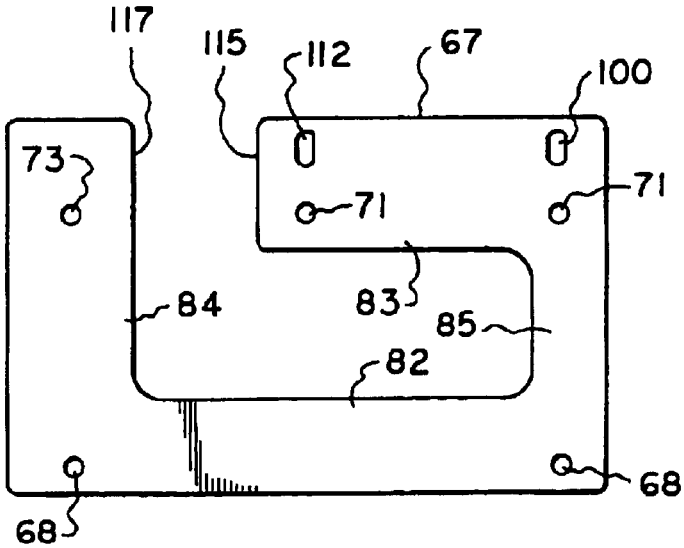
FIG. 14 is a side elevational view of one of two identical metal plates which are mounted on the sides of the lower body member of FIG. 13 for the purpose of mounting additional structure onto the lower body member and for providing side guides for a carriage.
Figure 26:
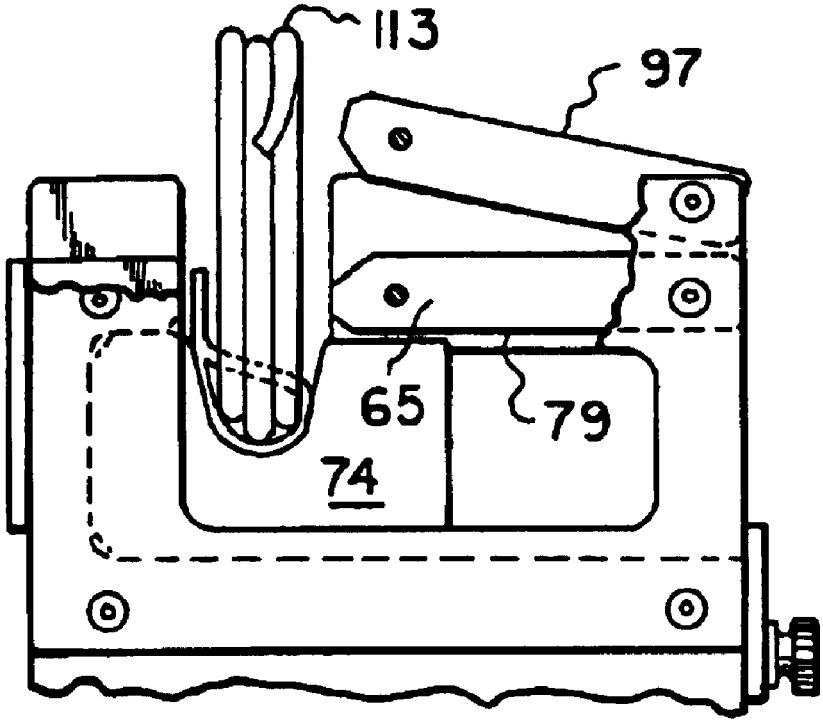
FIG. 26 is a fragmentary side elevational view similar to FIG. 25 but showing the carriage returned to a position wherein the banded coil can be withdrawn from the carriage.
Figure 17:
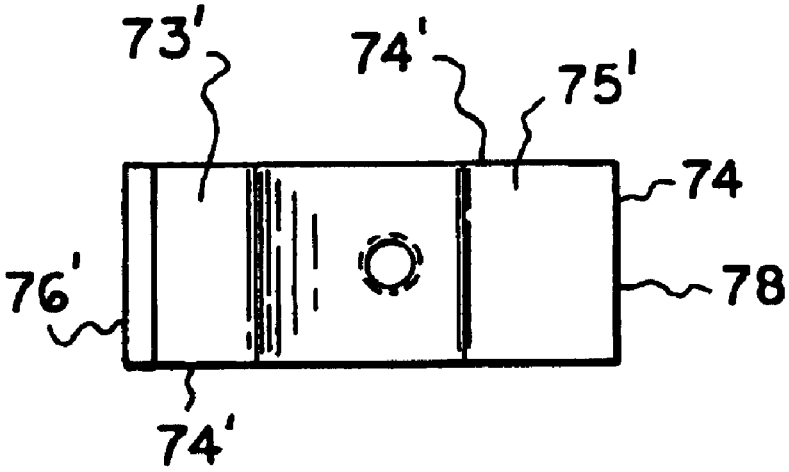
FIG. 17 is a plan view of the carriage taken in the direction of arrows 17—17 of FIG. 15.

In accordance with one aspect of the present invention, the fixture 60 has an improved band-receiving arrangement. One aspect of this arrangement is shown in FIGS. 10 and 22–26. In this respect, the substantially solid rectangular block 97 has its right end (FIGS. 10 and 11) secured to plates 67 by screws 99. The screws 99 also pass through elongated slots 100 (FIG. 14) in plates 67. Thus, the right end of block 97 can be adjusted in the vertical direction. The left end of block 97 is secured to plates 67 by brackets 101 (FIGS. 10, 20 and 21). The lower ends of brackets 101 have apertures 102 therein. Screws 70 pass through apertures 102 and are received in block 65. The upper ends of brackets 101 have apertures 103 therein. Screws 104 pass through apertures 103 and into block 97. As can be seen from FIGS. 10 and 22–26, a slot 105 is provided between blocks 65 and 97 which is in the shape of a wedge with the wide part 107 being the entry portion for band 109. Thus, in the event that band 109 has a relatively large upward curl, it will be received within slot 105 in the manner depicted in FIGS. 22 and 23.

In addition to the foregoing, it is to be noted from FIGS. 10, 10A and 22–26 that the tape 109 passes across the top 110 of horizontal member 64 and is restricted only by the upper portions 111 of plates 67. In other words, there is no block above horizontal member 64 and therefore the leading edge of band 109 does not have to pass through a slot. It is merely guided by the upper portions 11 of plates 67.

The slot between blocks 65 and 97 is adjustable from the position shown in FIG. 10 to the positions such as shown in FIGS. 18 and 19. In this respect, in FIG. 18 the slot 105*a* is shown in a condition in which it has been placed by adjusting the screws 99 and 104 in slots 100 and 112, respectively. In FIG. 19 the slot 105*b* is shown in an enlarged condition relative to slot 105*a* by adjusting the screws 99 and 104 to different positions in slots 100 and 112, respectively. Thus, as can be seen from a comparison of FIGS. 10, 18 and 19, the slots 105, 105*a* and 105*b* can be adjusted to different sizes depending on the curl of the particular banding material which is being used.

The sequence of banding a coil 113 is shown in FIGS. 22–26, and this sequence is similar to that described in detail above relative to FIGS. 5–9. Briefly, the band 109 is shown moving to the right and being inserted into slot 105 in FIGS. 22 and 23. Slot 105 is located between the lower wall (not numbered) of block 97 and the upper wall (not numbered) of block 65. Thereafter, as shown in FIG. 23, coil 113 is inserted through slot 114 between the inner edges 115 and 117 of plates 67 and into engagement with the central portion of band 109. Thereafter the coil 113 is moved downwardly through the slot portion 119 between the ends 120 and 121 of block 65 and member 64, respectively. The coil 13 is then inserted into carriage recess 76, as shown in FIG. 24. The carriage 74 is then moved from the position of FIG. 24 to the position of FIG. 25 so as to cause the ends of band 109 to overlie each other and be pressed together because of the engagement between upper surface 73' of carriage 74 and the undersurface 79 of block 65, with the two surfaces being biased toward each other by the action of spring-biased detent 95 bearing on surface 77 of lower body portion 62. Thereafter, the carriage is moved back to the position of FIG. 26, and the banded coil 113 is removed from the fixture.

In accordance with another aspect of the present invention, carriages having different recess configurations can be used in fixture 60. In this respect, a carriage having a recess configuration 76 is shown in FIG. 15. A carriage 74*a* is shown in FIG. 16 having a recess 76*a* which differs dimensionally from recess 76. All other dimensions may be the same except for the upper surfaces 73*a* and 75*a* which correspond to upper surfaces 73' and 75'. In order to remove carriage 74 from fixture 60, it is merely necessary to unscrew screw 123 (FIGS. 10 and 11) so as to pivot plate 124 from its obstructing orientation relative to window 125 (FIG. 11) to thereby permit carriage 74 to be slid out of the fixture through the window 125. Thereafter, a carriage, such as 74*a* of FIG. 16, can be slid into horizontal opening 75 through window 125 and thereafter plate 124 can be returned to its obstructing position relative to window 125. The window 125 is bounded by the inside surfaces of plate portions 85' and by surface 79 of block 65 and surface 77 of body portion 61.

While preferred embodiments of the present invention have been disclosed, it will be appreciated that the present invention is not limited thereto but may be otherwise embodied within the scope of the following claims.

What is claimed is:

1. A banding fixture comprising a body, a horizontal opening in said body, an overlying portion on said body overlying said horizontal opening, an undersurface on said overlying portion, a carriage movable into and out of said horizontal opening, a recess in said carriage, a carriage portion to the side of said recess, an upper surface on said carriage portion positionable in underlying near contiguous relationship with said undersurface, and a band-receiving slot in said body above said horizontal opening.

2. A banding fixture as set forth in claim 1 including a workpiece-receiving slot in said body extending transversely to said band-receiving slot.

3. A banding fixture as set forth in claim 2 wherein said workpiece-receiving slot includes a first workpiece-receiving slot portion above said band-receiving slot, and a second workpiece-receiving slot portion below said band-receiving slot.

4. A banding fixture as set forth in claim 2 wherein said band-receiving slot includes a first band-receiving slot portion on one side of said workpiece-receiving slot and a second band-receiving slot portion on the other side of said workpiece-receiving slot.

5. A banding fixture as set forth in claim 4 wherein said workpiece-receiving slot includes a first workpiece-receiving slot portion above said band-receiving slot, and a second workpiece-receiving slot portion below said band-receiving slot.

6. A banding fixture as set forth in claim 2 wherein said workpiece-receiving slot comprises a slot between said band-receiving slot and said horizontal opening.

7. A banding fixture as set forth in claim 6 wherein said band-receiving slot comprises a slot on one side of said workpiece-receiving slot.

8. A banding fixture as set forth in claim 1 including a second carriage portion on the opposite side of said recess from said carriage portion, and said second carriage portion being in underlying relationship with said undersurface when said recess is not in underlying relationship to said overlying portion.

9. A banding fixture as set forth in claim 8 including a workpiece-receiving slot in said body extending transversely to said band-receiving slot.

10. A banding fixture as set forth in claim 9 wherein said workpiece-receiving slot includes a first workpiece-receiving slot portion above said band-receiving slot, and a second workpiece-receiving slot portion below said band-receiving slot.

11. A banding fixture as set forth in claim 9 wherein said band-receiving slot includes a first band-receiving slot portion on one side of said workpiece-receiving slot and a second band-receiving slot portion on the other side of said workpiece-receiving slot.

12. A banding fixture as set forth in claim 11 wherein said workpiece-receiving slot includes a first workpiece-receiving slot portion above said band-receiving slot, and a second workpiece-receiving slot portion below said band-receiving slot.

13. A banding fixture as set forth in claim 9 wherein said workpiece-receiving slot comprises a slot between said band-receiving slot and said horizontal opening.

14. A banding fixture as set forth in claim 13 wherein said band-receiving slot comprises a slot on one side of said workpiece-receiving slot.

15. A banding fixture as set forth in claim 1 including a second upper surface on said second carriage portion, and wherein both said upper surface and said second upper surface are in underlying relationship to said undersurface when said recess is in underlying relationship to said overlying portion.

16. A banding fixture as set forth in claim 15 including a workpiece-receiving slot in said body extending transversely to said band-receiving slot.

17. A banding fixture as set forth in claim 16 wherein said workpiece-receiving slot includes a first workpiece-receiving slot portion above said band-receiving slot, and a second workpiece-receiving slot portion below said band-receiving slot.

18. A banding fixture as set forth in claim 16 wherein said band-receiving slot includes a first band-receiving slot portion on one side of said workpiece-receiving slot and a second band-receiving slot portion on the other side of said workpiece-receiving slot.

19. A banding fixture as set forth in claim 18 wherein said workpiece-receiving slot includes a first workpiece-receiving slot portion above said band-receiving slot, and a second workpiece-receiving slot portion below said band-receiving slot.

20. A banding fixture as set forth in claim 16 wherein said workpiece-receiving slot comprises a slot between said band-receiving slot and said horizontal opening.

21. A banding fixture as set forth in claim 20 wherein said band-receiving slot comprises a slot on one side of said workpiece-receiving slot.

22. A banding fixture comprising a body, a horizontal opening in said body, a carriage movable in said horizontal opening, a recess in said carriage, and a window in said body in substantial alignment with said horizontal opening.

23. A banding fixture as set forth in claim 22 including a window-blocking member movably mounted on said body.

24. A banding fixture as set forth in claim 23 including a bottom side on said carriage, a bottom wall defining the bottom of said horizontal opening, and a spring-biased member between said bottom side and said bottom wall.

25. A banding fixture as set forth in claim 24 including a band-receiving slot above said horizontal opening.

26. A banding fixture as set forth in claim 25 wherein said band-receiving slot is located between an upper wall and a lower wall.

27. A banding fixture as set forth in claim 26 including an adjustable mounting for said upper wall.

28. A banding fixture as set forth in claim 26 including a band entry surface in substantial alignment with said lower wall.

29. A banding fixture as set forth in claim 28 including spaced side walls on opposite sides of said band entry surface.

30. A banding fixture comprising a body, a horizontal opening in said body, a carriage movable in said horizontal opening, a recess in said carriage, and a band-receiving slot above said horizontal opening.

31. A banding fixture as set forth in claim 30 wherein said band-receiving slot is located between an upper wall and a lower wall.

32. A banding fixture as set forth in claim 31 including an adjustable mounting for said upper wall.

33. A banding fixture as set forth in claim 32 including a band entry surface in substantial alignment with said lower wall.

34. A banding fixture as set forth in claim 33 including spaced side walls on opposite sides of said band entry surface.

35. A banding fixture as set forth in claim 34 including a workpiece-receiving slot in said body below said band entry surface and said band-receiving surface.

* * * * *